US011390492B2

(12) United States Patent
Khzouz et al.

(10) Patent No.: US 11,390,492 B2
(45) Date of Patent: Jul. 19, 2022

(54) METHOD AND ASSEMBLY FOR POSITIONING AN ELEVATOR DOOR INTERLOCK

(71) Applicant: OTIS ELEVATOR COMPANY, Farmington, CT (US)

(72) Inventors: Erik Khzouz, Plainville, CT (US); Michael J. Tracey, Cromwell, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 463 days.

(21) Appl. No.: 15/967,906

(22) Filed: May 1, 2018

(65) Prior Publication Data

US 2019/0337769 A1 Nov. 7, 2019

(51) Int. Cl.

| | |
|---|---|
| ***B66B 13/12*** | (2006.01) |
| ***B66B 13/20*** | (2006.01) |
| ***B66B 13/30*** | (2006.01) |
| ***B66B 19/00*** | (2006.01) |

(52) U.S. Cl.

CPC ..... *B66B 13/12* (2013.01); *B66B 13/20* (2013.01); *B66B 13/30* (2013.01); *B66B 19/00* (2013.01)

(58) Field of Classification Search

CPC ..... B66B 13/12; B66B 13/20; B66B 13/30
See application file for complete search history.

(56) References Cited

U.S. PATENT DOCUMENTS

| | | | | |
|---|---|---|---|---|
| 3,912,049 | A | 10/1975 | Holland et al. | |
| 4,491,200 | A | 1/1985 | Thompson et al. | |
| 5,246,089 | A | 9/1993 | Husmann et al. | |
| 5,636,715 | A * | 6/1997 | Hayashi | B66B 13/12 187/330 |
| 5,819,877 | A | 10/1998 | Rivera et al. | |
| 6,945,363 | B2 | 9/2005 | Angst et al. | |
| 7,100,745 | B2 | 9/2006 | Bisang et al. | |
| 7,350,625 | B2 | 4/2008 | Deplazes et al. | |
| 7,370,731 | B2 | 5/2008 | Cocher | |
| 2001/0003319 | A1 * | 6/2001 | Itoh | B66B 13/12 187/333 |
| 2007/0039784 | A1 | 2/2007 | Koizumi et al. | |
| 2012/0118219 | A1 | 5/2012 | Lindberg et al. | |

(Continued)

FOREIGN PATENT DOCUMENTS

| | | | |
|---|---|---|---|
| CN | 102689833 | A | 9/2012 |
| EP | 1110900 | B2 | 7/2011 |
| EP | 2610205 | A1 | 7/2013 |

(Continued)

OTHER PUBLICATIONS

Extended European Search Report for EP Application No. 19172085.3, dated Nov. 28, 2019.

*Primary Examiner* — Minh Truong
(74) *Attorney, Agent, or Firm* — Carlson, Gaskey & Olds, P.C.

(57) ABSTRACT

An illustrative example method of positioning an elevator door interlock includes positioning an elevator car in a hoistway near the hoistway door so that at an elevator door coupler is aligned with the interlock, opening a door of the elevator car and the hoistway door, accessing an adjustment mechanism supporting the interlock from outside of the hoistway, and using the adjustment mechanism to adjust a position of the interlock relative to the hoistway door from outside the hoistway.

11 Claims, 2 Drawing Sheets

(56) References Cited

U.S. PATENT DOCUMENTS

| | | | |
|---|---|---|---|
| 2015/0336770 | A1 | 11/2015 | Barneman et al. |
| 2018/0079621 | A1 | 3/2018 | Fauconnet et al. |

FOREIGN PATENT DOCUMENTS

| | | | |
|---|---|---|---|
| EP | 3153454 | A1 | 4/2017 |
| JP | 5479567 | B1 | 4/2014 |
| WO | 2016/178047 | A1 | 11/2016 |

* cited by examiner

METHOD AND ASSEMBLY FOR POSITIONING AN ELEVATOR DOOR INTERLOCK

BACKGROUND

Elevator systems are in widespread use for carrying passengers between various levels in buildings, for example. Access to an elevator car requires that elevator car doors open when the car is at a landing at which a passenger desires to board the elevator car, for example. Each landing includes hoistway doors that move with the elevator car doors between open and closed positions.

There are various known coupler and interlock arrangements for coupling the elevator car doors to the hoistway doors so that the door mover that causes movement of the car doors also causes desired movement of the hoistway doors. Most door couplers include a set of vanes supported on the elevator car door structure. Most interlocks include a set of rollers supported on the hoistway door structure. When the rollers are received adjacent the vanes, it is possible to move both doors together. The movement of the car doors includes one of the vanes pushing on one of the rollers to move the hoistway door in one direction and the other vane pushing on the other roller to move the hoistway door in the other direction.

It is believed that elevator door system components account for approximately 50% of elevator maintenance requests and 30% of callbacks. Almost half of the callbacks due to a door system malfunction are related to one of the interlock functions.

Another drawback associated with known interlock arrangements is that the process of installing the interlocks along the hoistway is time-consuming and undesirably complicated. Each interlock has to be positioned to receive the coupler vanes as the elevator car approaches the corresponding landing. Inaccurate interlock placement may result in undesired contact between the coupler vanes and the interlock as the elevator car passes the landing, for example. Additionally, adjusting the rollers to achieve the necessary alignment with the coupler requires adjusting the position of the corresponding hoistway door lock and switch to ensure that the interlock properly cooperates with the lock. If the lock and switch components are not accurately positioned, the elevator may not perform reliably as indications from the switches along the hoistway are needed to ensure that all hoistway doors are closed before the elevator car moves along the hoistway.

SUMMARY

An illustrative example method of positioning an elevator door interlock includes positioning an elevator car in a hoistway near the hoistway door so that at an elevator door coupler is aligned with the interlock, opening a door of the elevator car and the hoistway door, accessing an adjustment mechanism supporting the interlock from outside of the hoistway, and using the adjustment mechanism to adjust a position of the interlock relative to the hoistway door from outside the hoistway.

In an embodiment having one or more features of the method of the previous paragraph, using the adjustment mechanism to adjust the position of the interlock includes causing relative movement between the hoistway door and the interlock until the hoistway door is in a selected alignment with the door of the elevator car.

In an embodiment having one or more features of the method of any of the previous paragraphs, the method includes subsequently securing the interlock in the adjusted position relative to the hoistway door.

In an embodiment having one or more features of the method of any of the previous paragraphs, securing the interlock occurs at least partially inside the hoistway.

In an embodiment having one or more features of the method of any of the previous paragraphs, accessing and using the adjustment mechanism is performed by an individual supported on at least one of a landing floor or a floor of the elevator car.

An illustrative example elevator door assembly includes a hoistway door that is moveable between an open and a closed position. The hoistway door includes a vertically oriented edge that is visible when the hoistway door is in the open position. An interlock includes a latch that is moveable between a door locking position and a released position, a lock that cooperates with the latch to lock the hoistway door when the latch is in the locking position, and at least one bumper configured to be contacted by a vane of an elevator door coupler at least for moving the latch into the released position. An adjustment mechanism that is accessible along the vertically oriented edge of the hoistway door when the hoistway door is in the open position selectively moves the interlock to adjust a position of the at least one bumper relative to the hoistway door.

In an embodiment having one or more features of the elevator door assembly of the previous paragraph, the adjustment mechanism comprises a carrier, the interlock being supported at least partially on the carrier, a moving member and a follower associated with the carrier, the follower moving responsive to movement of the moving member selectively move the carrier and the interlock.

In an embodiment having one or more features of either of the elevator door assemblies of any of the previous paragraphs, the moving member comprises a rod having one end situated near the vertically oriented edge of the hoistway door and the follower moves longitudinally along the rod.

In an embodiment having one or more features of any of the elevator door assemblies of any of the previous paragraphs, the rod is threaded, the rod is selectively rotated and the follower moves longitudinally along the rod responsive to rotation of the rod.

In an embodiment having one or more features of any of the elevator door assemblies of any of the previous paragraphs, the carrier comprises a carrier bracket and the follower comprises at least one nut coupled with the carrier bracket.

The various features and advantages of an example embodiment will become apparent to those skilled in the art from the following detailed description. The drawings that accompany the detailed description can be briefly described as follows.

DETAILED DESCRIPTION

Embodiments of this invention provide an elevator door interlock assembly and a method that allows the interlock to be adjusted for proper alignment with an elevator car door coupler without requiring an individual to enter a hoistway.

Figure 1:
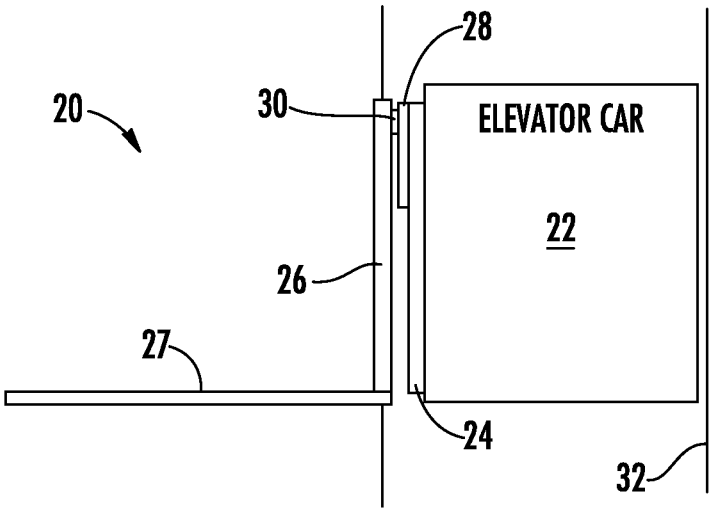
FIG. 1 schematically illustrates selected portions of an elevator system including a door interlock designed according to an embodiment of this invention.

FIG. 1 schematically illustrates selected portions of an elevator system 20. An elevator car 22 includes car doors 24 that are situated adjacent hoistway doors 26 when the elevator car 22 is parked at a landing 27. At least one vane 28 of a door coupler associated with the elevator car doors 24 cooperates with an interlock 30 associated with the hoistway doors 26 so that the elevator car doors 24 and the hoistway doors 26 move together between open and closed positions. A position of the interlock 30 relative to the hoistway door 26 can be adjusted without requiring an individual, such as a mechanic or technician, to enter a hoistway 32.

Figure 2:
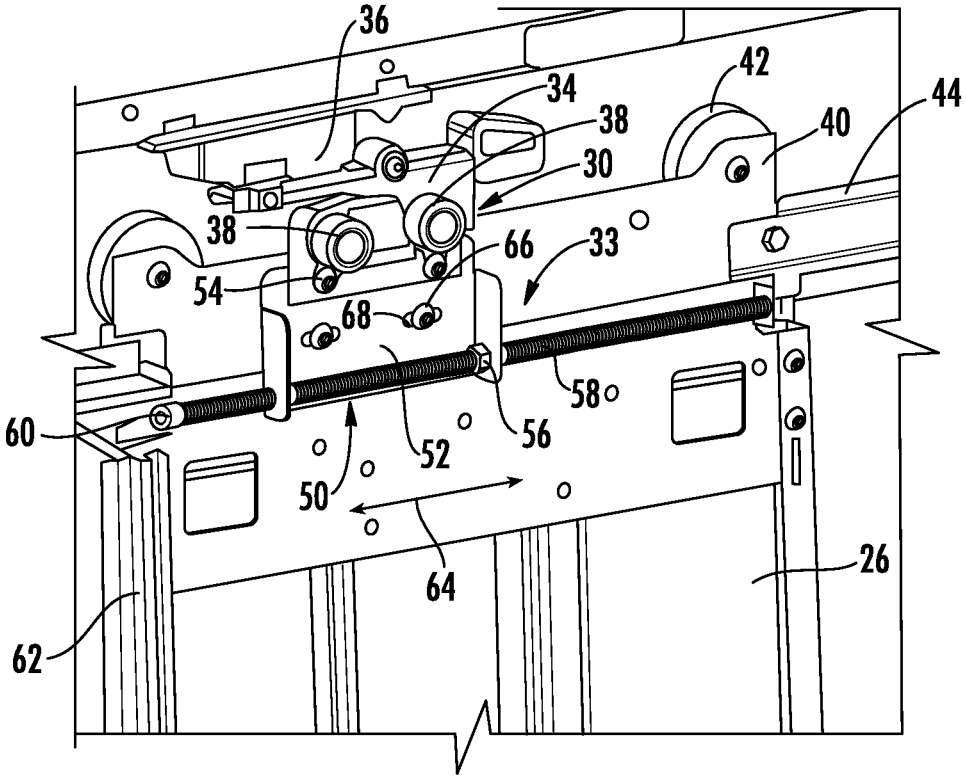
FIG. 2 is schematically shows an example elevator door interlock assembly designed according to an embodiment of this invention.

FIG. 2 shows an assembly 33 including the interlock 30 of an example embodiment. The interlock 30 includes a latch 34 that is selectively moveable between a locked position (shown in FIG. 2) and a released position. In the locked position, the latch 34 cooperates with a lock 36 to lock the hoistway door 26 so that it cannot be opened. The interlock 30 includes bumpers 38, which comprise rollers in the illustrated example embodiment. The bumpers 38 cooperate with the vane or vanes 28 of the door coupler for opening and closing the hoistway door 26 with the elevator car door 24. The manner in which the interlock 30 and door coupler cooperate for unlocking and moving the hoistway door 26 is known.

The interlock 30 is configured to be supported on a component of the hoistway door 26, such as the hanger bracket 40. Rollers 42 associated with the hanger bracket 40 follow a track 44 during movement of the hoistway door 26.

The manner in which the interlock 30 is positioned relative to the hoistway door 26 depends on an adjustment mechanism 50. In this example, the adjustment mechanism 50 includes a carrier bracket 52. The interlock 30 is secured to the carrier bracket 52 by fasteners 54. A follower 56 associated with the carrier bracket 52 follows along a moving member 58. In this example embodiment, the moving member 58 comprises a threaded rod having one end 60 that is accessible along one vertically oriented edge 62 of the hoistway door 26. The vertically oriented edge 62 is visible or exposed when the hoistway door 26 is open. In the illustrated example embodiment, the end 60 is configured with a drive head or socket, for example, to allow the moving member 58 to be rotated by an individual situated near the vertical edge 62 of the hoistway door 26. The follower 56 in this example comprises a threaded member, such as a nut, that moves along the threaded rod 58 causing horizontal translation of the carrier bracket 52 and interlock 30 relative to the hoistway door 26 as schematically represented by the arrows 64 based on rotary movement of the threaded rod 58.

In the example embodiment of FIG. 2, fasteners 66 coupled with the hanger bracket 40 and slots 68 on the carrier bracket 52 cooperate to establish a range of adjustment possible between the interlock 30 and the hoistway door 26. The fasteners 66 in this example embodiment also allow for securing the carrier bracket 52 and the interlock 30 in a desired position relative to the hanger bracket 40 and hoistway door 26.

The interlock 30 in this example is designed such that lateral movement of the latch 34 results in corresponding lateral movement of the lock 36. A mechanical coupling or interaction between the latch 34 and the lock 36 ensures a consistent alignment between the latch 34 and the lock 36 to avoid additional adjustments required between those components once the desired interlock position has been obtained.

Figure 3:
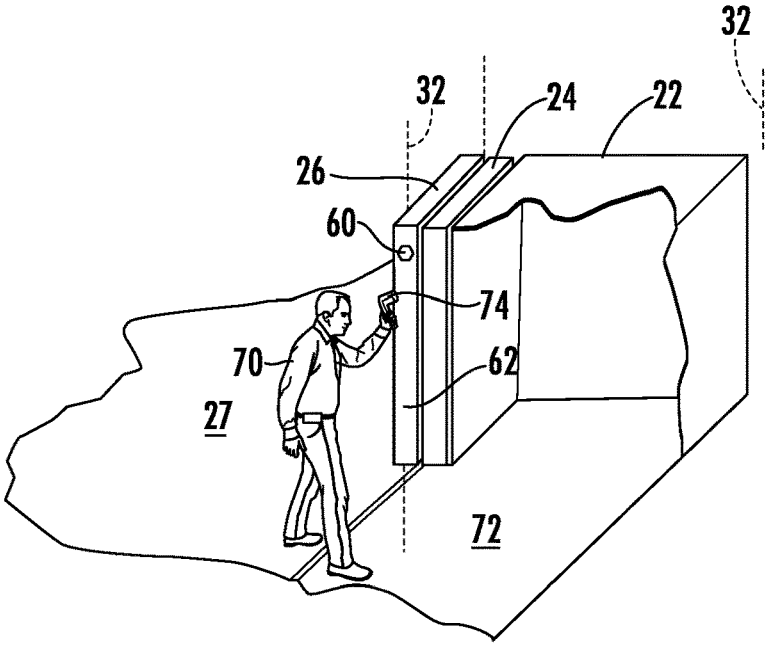
FIG. 3 schematically shows an example technique of adjusting the position of the example interlock assembly of FIG. 2.

As schematically shown in FIG. 3, an individual 70 can access the end 60 of the moving member 58 when the individual 70 is positioned near the vertical edge 62 of the hoistway door 26. In the illustration, the individual 70 does not need to enter the hoistway 32 for purposes of adjusting a position of the interlock 30 relative to the hoistway door 26. Such adjustments are necessary to properly align the bumpers 38 with the vanes 28 of the elevator car door coupler. The individual 70 may stand on the landing floor 27, the elevator car floor 72, or both as illustrated and utilize a tool 74 to cause the adjustment mechanism 50 to adjust the position of the interlock 30 as desired. Without an adjustment mechanism, such as the adjustment mechanism 50, the individual 70 would have had to enter the hoistway 32, typically on top of the elevator car 22, to gain access to the interlock 30 for purposes of adjusting a position of the interlock 30. With the example embodiment, the individual 70 remains outside of the hoistway 32, which eliminates multiple potential concerns associated with an individual entering the hoistway 32.

In the illustrated example, the individual 70 uses a tool 74, such as a powered driver or drill, to rotate the threaded rod 58 to cause movement of the interlock 30 into a desired alignment with the door coupler.

Figure 4:
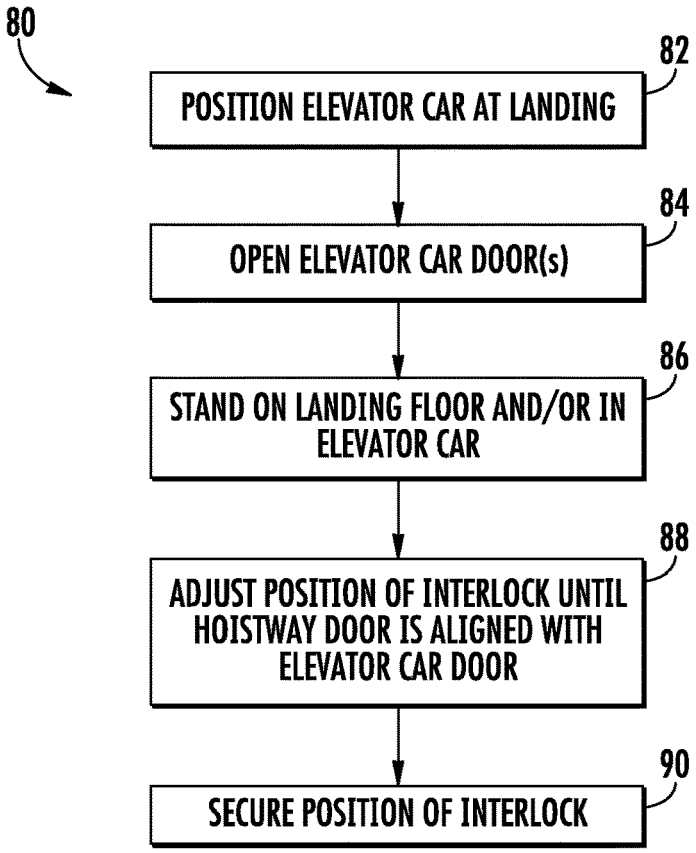
FIG. 4 is a flow chart diagram summarizing an adjustment technique according to an embodiment of this invention.

FIG. 4 includes a flowchart diagram 80 summarizing an example approach for achieving a desired alignment between a door coupler and the interlock 30. At 82, an authorized individual positions the elevator car 22 at the landing 27. At 84, the elevator car doors 24 open. Assuming some interaction between the door coupler and the interlock 30, the hoistway door 26 will open with the elevator car door. Once the elevator car door is fully opened and held in that position, the individual 70 stands on the landing floor 27, the floor of the elevator car 72 or both at 86. At 88, the individual 70 adjusts the position of the interlock 30 using the adjustment mechanism 50. According to this technique, the elevator car door 24 is in a set position and the interlock 30 is engaged with the door coupler. The adjustment mechanism 50 causes relative movement between the interlock 30 and the hoistway door 26. With the elevator car door 24 in a set position, the adjustment mechanism 50 effectively moves the hoistway door 26. The individual 70 utilizes the adjustment mechanism 50 to adjust the position of the interlock 30 relative to the hoistway door 26 until the hoistway door is properly aligned with the elevator car door at 88.

For example, aligning the vertically oriented edge 62 of the hoistway door 26 with a corresponding edge of the elevator car door 24 in the fully opened position will result in the interlock 30 being in a position relative to the hoistway door 26 that provides proper alignment with the door coupler. When the elevator car door 24 closes, the alignment between the vertically oriented edges of the doors will bring the hoistway door 26 to a fully closed position leaving the interlock 30 in the proper location for appropriate engagement with the vanes 28 of the door coupler during elevator system operation. Such door alignment may vary depending on the particular door configuration.

According to the example of FIG. 4, the position of the interlock 30 is secured in a desired position at 90. In embodiments where the adjustment mechanism 50 includes a ratchet-style configuration, the interlock 30 may be automatically secured in a selected position upon the final adjustment of the adjustment mechanism.

In some embodiments, a final position of the lock 36 is secured by an individual gaining access to the lock components from inside the hoistway 32 to secure the lock 36 in the appropriate position. Even in situations where such hoistway access is required, there still are efficiencies obtained by allowing for the adjustment mechanism 50 to be accessed from outside the hoistway. An individual can, for example, travel to each landing along a hoistway and achieve the proper alignment between the interlocks 30 and the door coupler for each set of landing doors. That individual can subsequently enter the hoistway and secure down any components as needed to maintain the desired final position of the interlock 30 and the lock 36 at each set of hoistway doors.

Embodiments of this invention provide for reliable and convenient alignment between hoistway door interlocks and the elevator car door coupler. Such alignment is possible without requiring an individual to enter a hoistway or climb on top of an elevator car.

The preceding description is exemplary rather than limiting in nature. Variations and modifications to the disclosed examples may become apparent to those skilled in the art that do not necessarily depart from the essence of this invention. The scope of legal protection given to this invention can only be determined by studying the following claims.

We claim:

1. A method of positioning a hoistway door that selectively closes off an opening into a hoistway and an associated interlock that cooperates with a lock that locks the hoistway door in a closed position, the method comprising:

positioning an elevator car in the hoistway near the hoistway door so that an elevator door coupler is aligned with and engages the interlock associated with the hoistway door;

opening a door of the elevator car and the hoistway door;

accessing an adjustment mechanism from a position outside of the hoistway, the position being on at least one of a landing floor or a floor of the elevator car; and using the adjustment mechanism from the position outside of the hoistway to adjust a horizontal position of the interlock relative to the hoistway door while causing corresponding horizontal movement of the lock until the interlock is aligned with the elevator door coupler, the interlock is aligned with the lock, and the hoistway door is in a selected alignment with the door of the elevator car wherein the hoistway door is supported on a hanger bracket, the interlock is supported on a carrier bracket, the carrier bracket is supported on the hanger bracket in a manner that provides a range of horizontal adjustment between the hoistway door and the interlock, fasteners on the hanger bracket are received at least partially through slots on the carrier bracket, and the slots and the fasteners establish the range of horizontal adjustment between the hoistway door and the interlock.

2. The method of claim 1, comprising subsequently securing the interlock in the adjusted position relative to the hoistway door.

3. The method of claim 2, wherein securing the interlock occurs at least partially inside the hoistway.

4. The method of claim 1, wherein accessing and using the adjustment mechanism is performed by an individual in the position outside of the hoistway.

5. The method of claim 1, wherein engagement between the elevator door coupler and the interlock prevents movement of the interlock relative to the elevator door coupler.

6. The method of claim 5, wherein the adjustment mechanism is accessible along a vertically oriented edge of the hoistway door when the hoistway door is in the open position.

7. The method of claim 6, wherein the adjustment mechanism comprises a moving member; and a follower associated with the carrier bracket, the follower moving responsive to movement of the moving member to selectively move the carrier bracket and the interlock.

8. The method of claim 7, wherein the moving member comprises a rod having one end situated near the vertically oriented edge of the hoistway door; and the follower moves longitudinally along the rod.

9. The method of claim 8, wherein the rod is threaded;

the rod is selectively rotated; and the follower moves longitudinally along the rod responsive to rotation of the rod.

10. The method of claim 9, wherein;

and the follower comprises at least one nut coupled with the carrier bracket.

11. The method of claim 1, wherein the interlock includes a latch that is moveable between a door locking position and a released position, and at least one bumper configured to be contacted by a vane of the elevator door coupler at least for moving the latch into the released position; and the lock cooperates with the latch to lock the hoistway door when the latch is in the locking position.

* * * * *